US010576391B1

(12) United States Patent
Tong et al.

(10) Patent No.: US 10,576,391 B1
(45) Date of Patent: Mar. 3, 2020

(54) BUILDING PIECE COMPRISING TWO RIGID INTERLOCKABLE WINGS AND A FLEXIBLE BELT THEREBETWEEN

(71) Applicants: Kun Yuan Tong, Suwanee, GA (US); John Tong, Southlake, TX (US)

(72) Inventors: Kun Yuan Tong, Suwanee, GA (US); John Tong, Southlake, TX (US)

( * ) Notice: Subject to any disclaimer, the term of this patent is extended or adjusted under 35 U.S.C. 154(b) by 0 days.

(21) Appl. No.: 16/270,565

(22) Filed: Feb. 7, 2019

(51) Int. Cl.
*A63H 33/04* (2006.01)
*A63H 33/08* (2006.01)

(52) U.S. Cl.
CPC ..... *A63H 33/086* (2013.01)

(58) Field of Classification Search
USPC ..... 446/96, 106, 107, 119, 124, 126, 490
See application file for complete search history.

(56) References Cited

U.S. PATENT DOCUMENTS 3,050,578 A * 8/1962 Huebner ..... F16L 3/2235 174/40 CC
3,086,529 A * 4/1963 Munz ..... A61B 17/1322 606/203
3,192,589 A * 7/1965 Pearson ..... A44B 18/0053 24/452
3,242,610 A * 3/1966 Christiansen ..... A63H 33/086 446/128
3,558,138 A * 1/1971 Lemelson ..... A63H 3/16 273/157 R
3,604,145 A * 9/1971 Zimmerman ..... A63H 33/065 446/108
3,654,049 A * 4/1972 Ausnit ..... A44B 19/16 24/16 PB
4,147,007 A * 4/1979 Eppich ..... F16B 5/07 446/114
5,289,619 A * 3/1994 Pileggi ..... A44B 18/00 24/17 AP
5,713,782 A * 2/1998 Jensen ..... A63H 5/00 446/419
6,000,984 A * 12/1999 Degner
6,347,421 B1 * 2/2002 D'Emilio ..... A47C 7/383 297/391
6,568,981 B1 * 5/2003 Chang ..... A63H 33/048 24/306
6,679,751 B1 * 1/2004 Maxwell ..... A63H 33/00 446/124
6,763,554 B1 * 7/2004 Torrey ..... B65D 63/10 24/17 AP
6,763,556 B2 * 7/2004 Fagan ..... A44B 18/0053 24/452
D511,450 S * 11/2005 Seth ..... D20/22
(Continued)

*Primary Examiner* — Nini F Legesse
(74) *Attorney, Agent, or Firm* — Guosheng Wang; United States Research and Patent Firm

(57) ABSTRACT

The present invention provides a building piece comprising a first wing, a second wing, and a flexible belt connecting said two wings. The first wing has a first front side and a first back side, and the second wing has a second front side and a second back side. At least two of the four sides each comprise a topographical profile or a landscape. In the present invention, the term "landscape" can be used interchangeably with the term "topographical profile". The landscape on any one of the at least two sides can be reversibly interlocked, or is reversibly interlockable, to another one of the at least two sides.

12 Claims, 10 Drawing Sheets

(56) References Cited

U.S. PATENT DOCUMENTS

| | | | | |
|---|---|---|---|---|
| 7,950,114 | B2 * | 5/2011 | Duffy | A44B 18/0049 24/445 |
| 8,458,864 | B1 * | 6/2013 | Patton | A61F 5/3792 24/16 R |
| 9,011,193 | B1 * | 4/2015 | Dochtermann, III | A63H 33/042 446/124 |
| 9,937,433 | B2 * | 4/2018 | Stolten | A63H 33/086 |

* cited by examiner

BUILDING PIECE COMPRISING TWO RIGID INTERLOCKABLE WINGS AND A FLEXIBLE BELT THEREBETWEEN

FIELD OF THE INVENTION

The present invention generally relates to a building piece used for a construction set that allows for the construction of a variety of different models. The building piece includes two wings and a flexible belt connecting the two wings. The wings include at least two landscapes or (two topographical profiles) that can be reversibly interlocked to each other.

BACKGROUND OF THE INVENTION

Playing with toys can be an enjoyable means of training young children for life in society. It provides entertainment while fulfilling an educational role. Playing with toys is considered to be important when it comes to growing up and learning about the world around us. Younger children use toys to discover their identity, help their bodies grow strong, learn cause and effect, explore relationships, and practice skills they will need as adults. Toys enhance children's cognitive behavior and stimulate their creativity.

Among existing assembly toys, the toy block structure is formed by fitting toy blocks having concave and convex portions. For example, Lego allows a desired shape to be formed by assembling hexagonal blocks. Each of Lego blocks has a protrusion and a recess such that the Lego blocks are coupled to each other, and the Lego blocks may be assembled in various shapes by using the protrusions and recesses. Lego extends (or is built longitudinally) along direction of the protrusions and the recesses. Accordingly, it is relatively difficult to assemble the shape that extends or is built laterally and there are many restrictions in manufacturing a desired shape by the user.

Therefore, there exists a need to overcome the aforementioned problems. Advantageously, the present invention provides a solution.

SUMMARY OF THE INVENTION

One aspect of the present invention provides a building piece comprising a first wing, a second wing, and a flexible belt connecting said two wings. The first wing has a first front side and a first back side, and the second wing has a second front side and a second back side. At least two of the four sides each comprise a topographical profile or a landscape. In the present invention, the term "landscape" can be used interchangeably with the term "topographical profile". The landscape on any one of the at least two sides can be reversibly interlocked, or is reversibly interlockable, to another one of the at least two sides.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form, omitted, or merely suggested, in order to avoid unnecessarily obscuring the present invention.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

Figure 1:
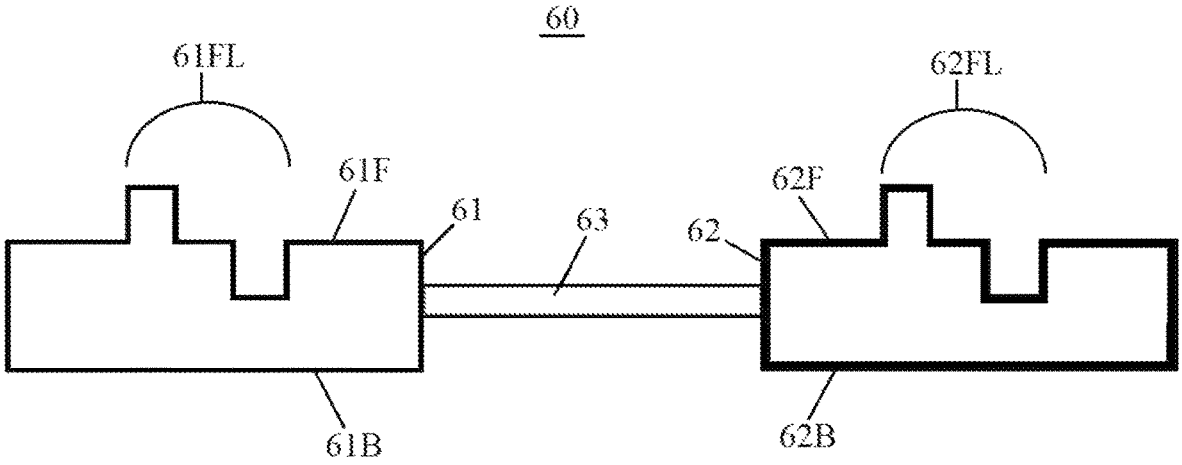
FIG. 1 schematically illustrates a building piece with two landscapes in accordance with an exemplary embodiment of the present invention.

With reference to FIG. 1, a building piece 60 includes a first rigid wing 61, a second rigid wing 62, and a flexible belt 63 connecting the two rigid wings (61, 62). The first wing 61 has a first front side 61F and a first back side 61B, and the second wing 62 has a second front side 62F and a second back side 62B. At least two of the four sides, for example sides 61F and 62F as shown in FIG. 1, each comprises a landscape, e.g. 61FL and 62FL. The four sides are like four lands, and the term "landscape" is a topographical profile of the land. Topography is the study of the shape and features of land surfaces. The topography of an area could refer to the surface shapes and features.

Figure 2:
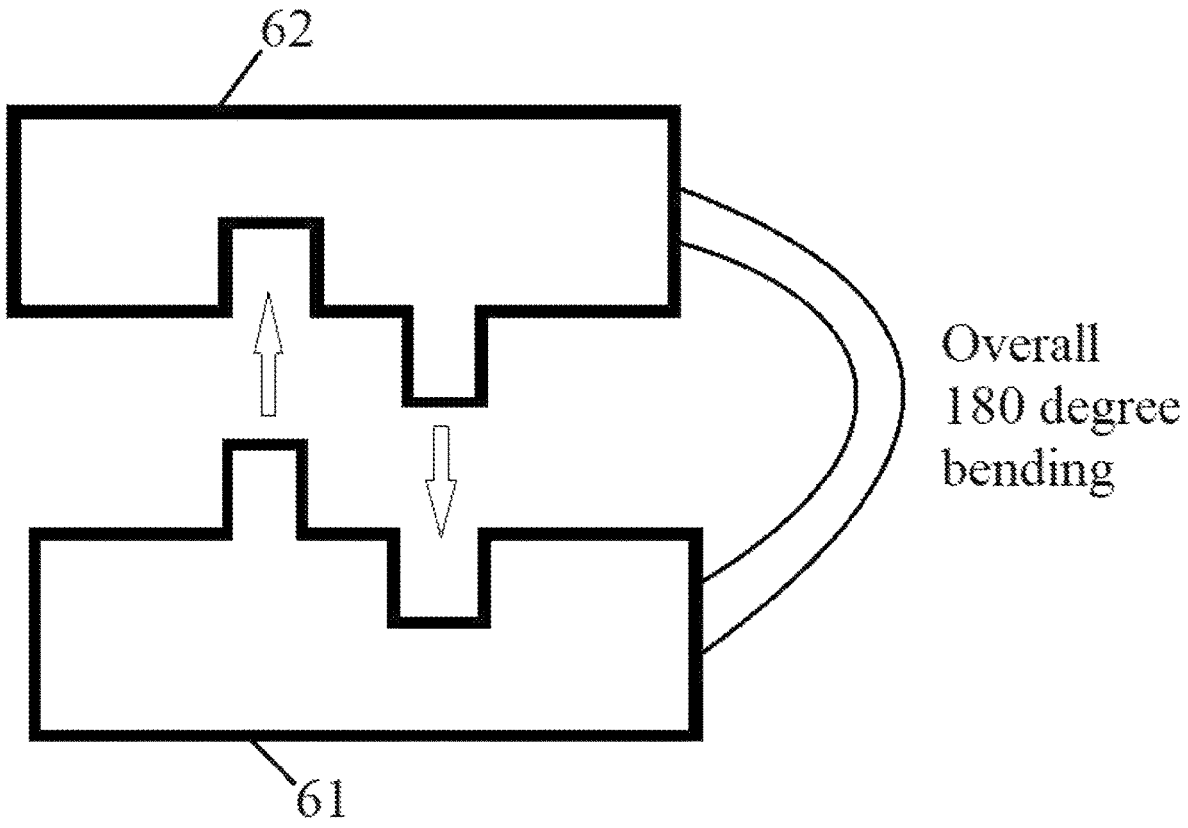
FIG. 2 shows the connection of two wings in a building piece in accordance with an exemplary embodiment of the present invention.
Figure 3:
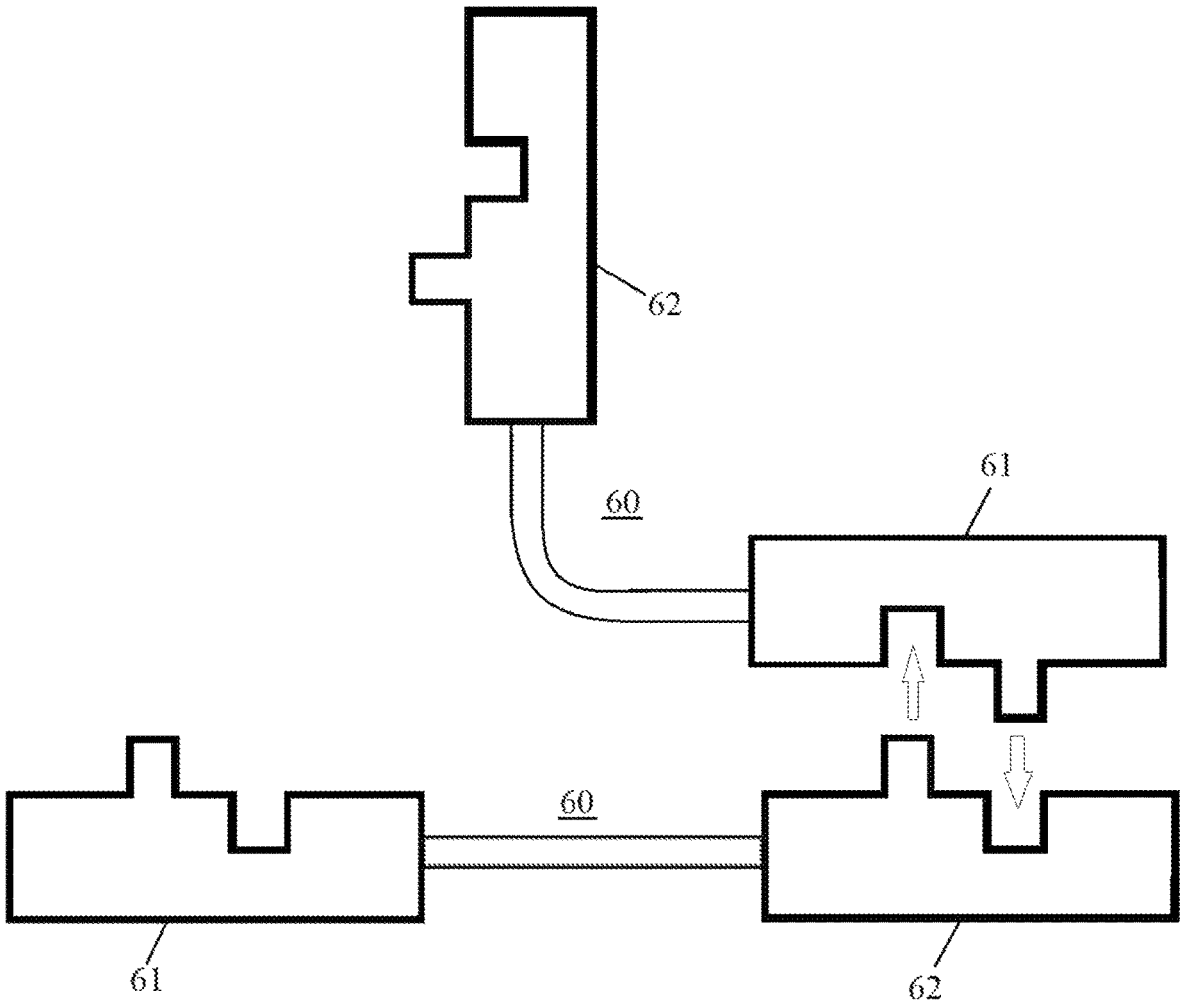
FIG. 3 illustrates one way of connecting two building pieces in accordance with an exemplary embodiment of the present invention.

The at least two landscapes may be structurally mutually complementary to each other, and are therefore capable of interlocking to each other, or fit into each other. As shown in FIG. 2, the landscape on any one of said at least two sides (e.g. 61FL) can be reversibly interlocked (interlockable) to another one of said at least two sides (e.g. 62FL), like two Lego pieces are connectable to each other. Of course, landscape 61FL from one building piece 60 is also interlockable to landscape 62FL from another identical building piece 60, as shown in FIG. 3.

Figure 4:
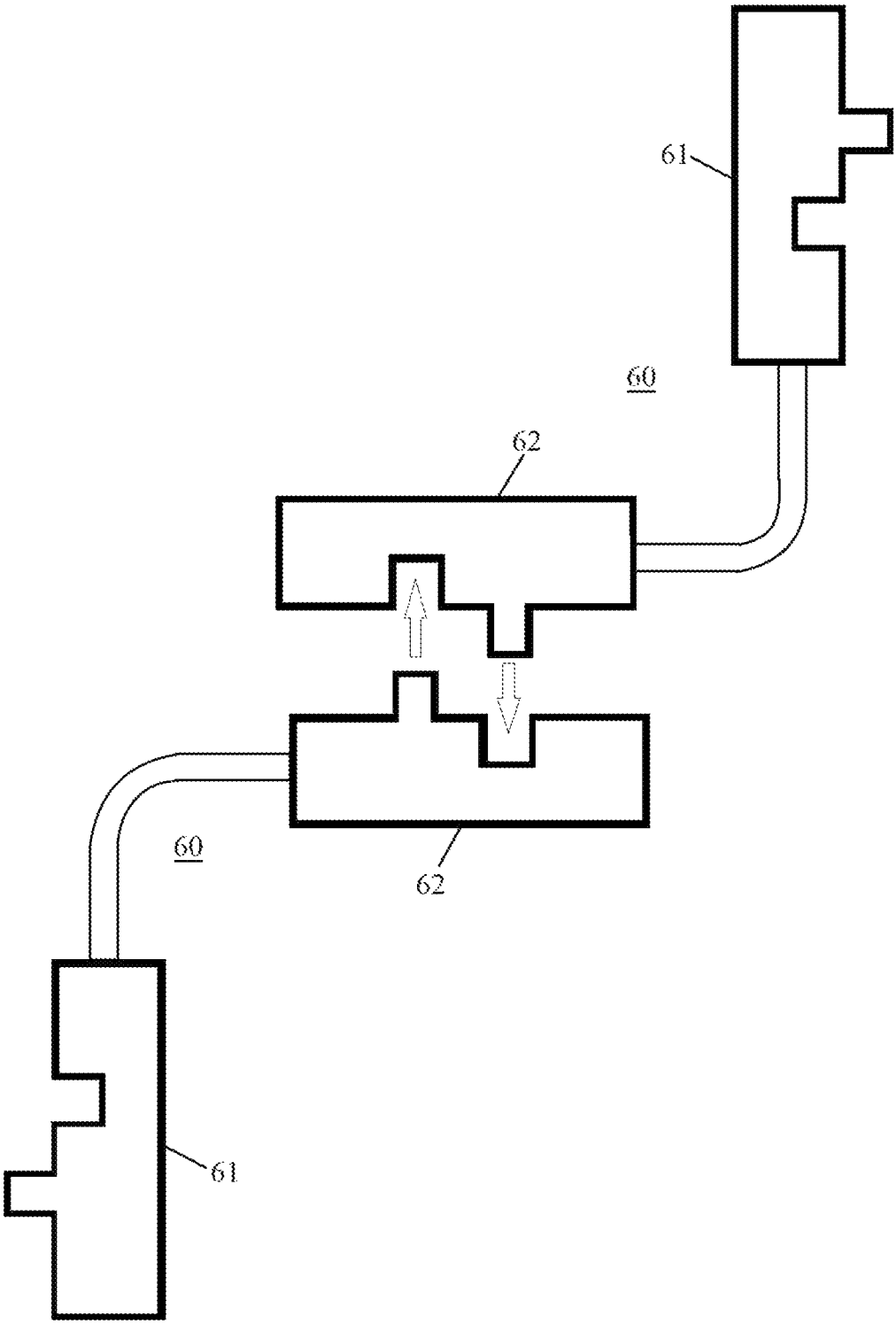
FIG. 4 illustrates another way of connecting two building pieces in accordance with an exemplary embodiment of the present invention.

In preferred embodiments, the landscape on any one of the at least two sides can be reversibly interlocked to the landscape on a counterpart side in another identical building piece (i.e. it can interlock to itself). Referring to FIG. 4, the landscape 62FL can be reversibly interlocked to the landscape 62FL on a counterpart side 62F in another identical building piece 60. In other words, any landscape (61FL or 62FL) is interlockable to itself.

Figure 5:
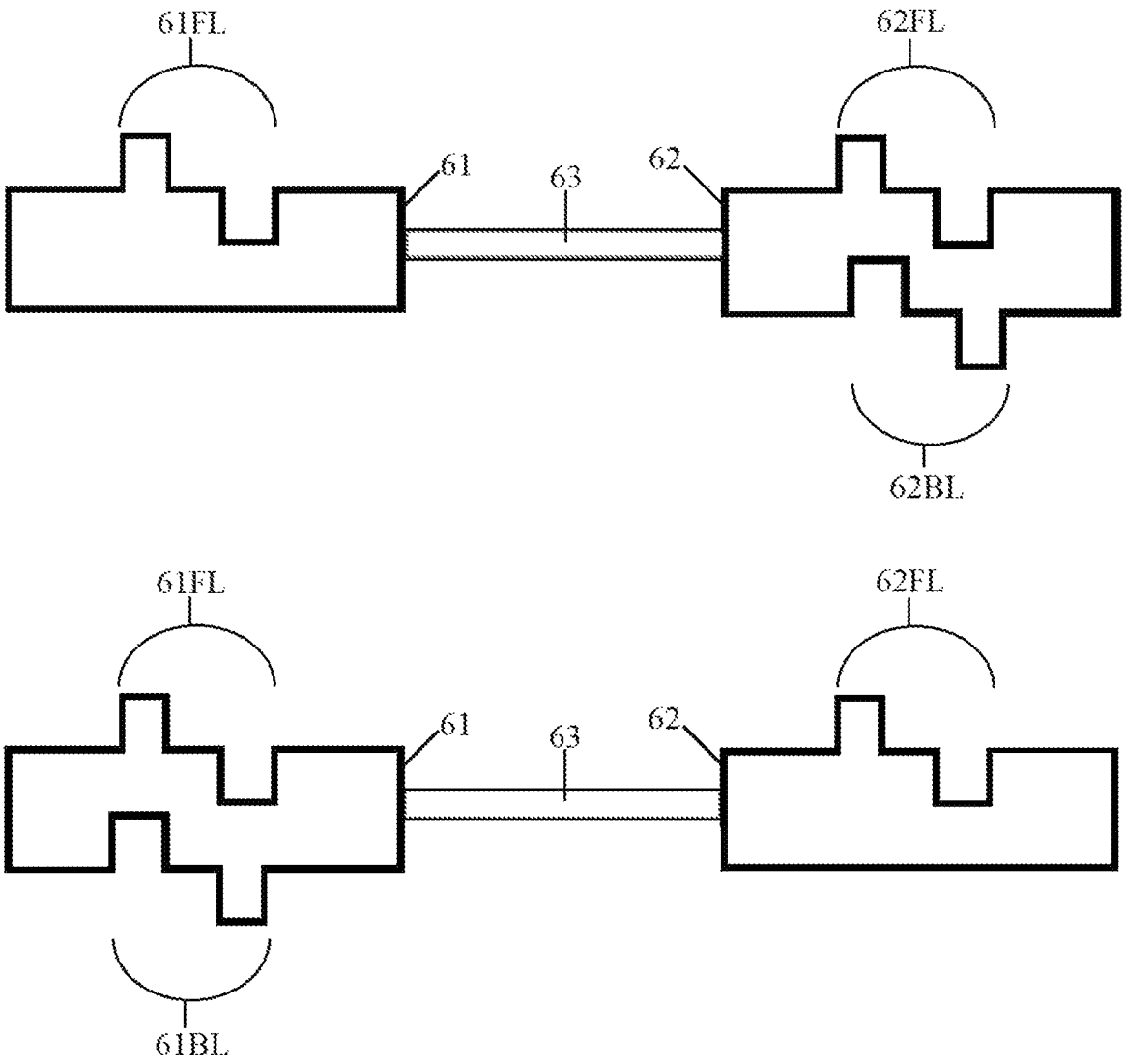
FIG. 5 schematically illustrates examples of building pieces with three landscapes in accordance with an exemplary embodiment of the present invention.

In some embodiments, any three of the four sides (61F, 62F, 61B and 62B) may each comprise a landscape. As shown in FIG. 5, building piece 60 may have only three landscapes, i.e. 61FL, 62FL, and 61BL; or 61FL, 62FL, and 62BL. Any two of the three landscapes are structurally mutually complementary to each other, and are interlockable to each other, in a manner as described and illustrated above. It should also be noted that the landscape on any one of the 3 sides can be reversibly interlocked to the landscape on a counterpart side in another identical building piece (i.e. it can interlock to itself). For example, landscape 61FL is interlockable to another identical landscape 61FL; landscape 62FL is interlockable to another identical landscape 62FL; landscape 61BL is interlockable to another identical landscape 61BL; and landscape 62BL is interlockable to another identical landscape 62BL.

Figure 6:
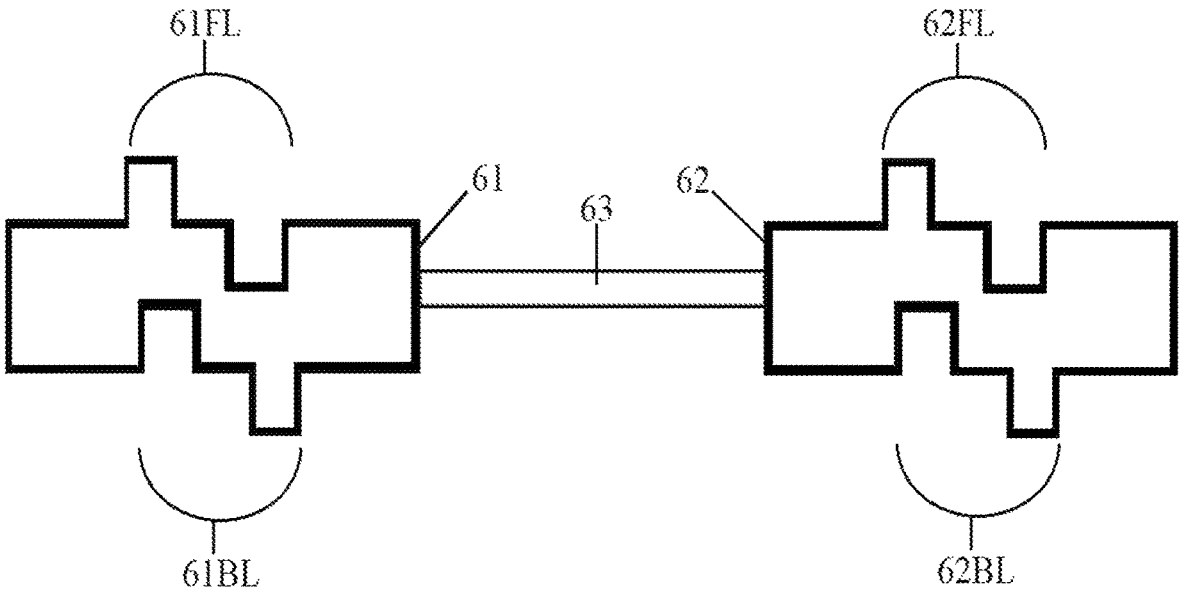
FIG. 6 schematically illustrates a building piece with four landscapes in accordance with an exemplary embodiment of the present invention.

In preferred embodiments, all the four sides (61F, 62F, 61B and 62B) may each comprise a landscape. As shown in FIG. 6, building piece 60 may have four landscapes, i.e. 61FL, 62FL, 61BL and 62BL. Any two of the four landscapes are structurally mutually complementary to each other, and are interlockable to each other, in a manner as described and illustrated above. It should also be noted that the landscape on any one of the 4 sides can be reversibly interlocked to the landscape on a counterpart side in another identical building piece (i.e. it can interlock to itself). For example, landscape 61FL is interlockable to another identical landscape 61FL; landscape 62FL is interlockable to another identical landscape 62FL; landscape 61BL is interlockable to another identical landscape 61BL; and landscape 62BL is interlockable to another identical landscape 62BL.

Figure 7:
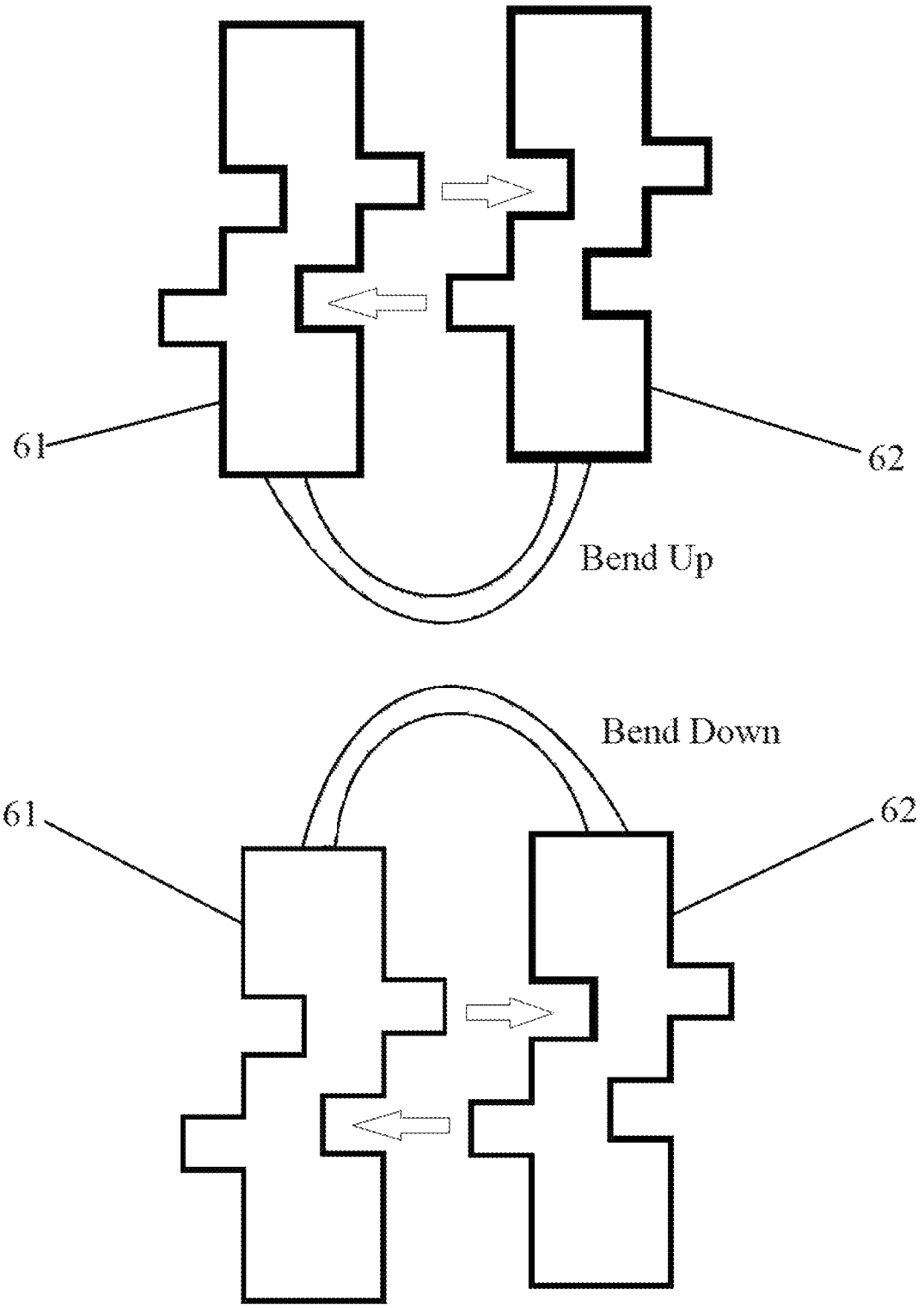
FIG. 7 schematically illustrates two configurations formed by a building piece with four landscapes in accordance with an exemplary embodiment of the present invention.

FIG. 7 shows two exemplary configurations of a single building piece 60. In the "Bend Up" configuration, landscape 61FL is interlocked to landscape 62FL, while in the "Bend Down" configuration, landscape 61BL is interlocked to landscape 62BL. Generally, landscape 61FL can be interlocked to any one of landscapes 61FL, 62FL, 61BL and 62BL from the same or different building piece. Landscape 62FL can be interlocked to any one of landscapes 61FL, 62FL, 61BL and 62BL from the same or different building piece. Landscape 61BL can be interlocked to any one of landscapes 61FL, 62FL, 61BL and 62BL from the same or different building piece. Landscape 62BL can be interlocked to any one of landscapes 61FL, 62FL, 61BL and 62BL from the same or different building piece. Therefore, a lot of configurations can be formed by interlocking two, three, four or more building pieces 60 together in many different ways.

The flexible belt 63 can be bent or twisted at a degree of from −180° to +180° by human hands, preferably by a child's hands. The wings 61/62 should be much more rigid than belt 63, for example, it can only be bent or twisted at a degree of from −5° to +50 by human hands. Therefore, the material of the flexible belt 63 may be different from the material of the wings 61/62. For example, the material of the wings (e.g. Acrylonitrile butadiene styrene, ABS) may have an elastic modulus that is at least 0.5, 1, 1.5, 2, 3, 4 or 5 times higher than that of the material (e.g. natural or synthetic rubber) of the flexible belt 63. The term "elastic modulus" is a quantity that measures an object or substance's resistance to being deformed elastically (i.e., non-permanently) when a stress such as a human hand force is applied to it. Alternatively, the wings 61/62 may have a thickness that is at least 2, 3, 4, or 5 times thicker than the thickness of the flexible belt 63, particularly when the wings and the belt are made of the same material for convenient manufacturability. Thickness optimization can make the belt 63 sufficiently flexible and the wings 61/62 sufficiently rigid.

When two or more building pieces, same or different, are used together as one set, the wings may be, or include, any suitable Lego piece, brick, block, gear, figurine, and minifigure etc. In other words, wings 61 and 62 can be any known Lego pieces.

In the following, three specific embodiments of building piece 60 in FIG. 6 will be illustrated and described in more details. In these embodiments, building pieces 60 may look like a butterfly-shaped building block. The landscape may include multiple parallel interlocking prominences which enable one wing to interlock with another wing. As a result, two or more building pieces can connect to each other to create a construction with a shape of human, animal, or plant such as lobster, butterfly, peacock and chicken. The wings may have a triangle shape, an elongated shape, a rectangular shape, a square shape, a diamond shape, a star shape, a leaf shape, an animal shape, a plant shape, a round shape, a gourd shape, or any combination thereof. Typically, the landscape may include long strips (prominences, protrusions, or convex portions) built on the wings at horizontal line or oblique line, with same degree of angle and spaced out at a distance equal to the strips' width. Two adjacent strips will form a gap (recesses or concave portions) therebetween.

Figure 8:
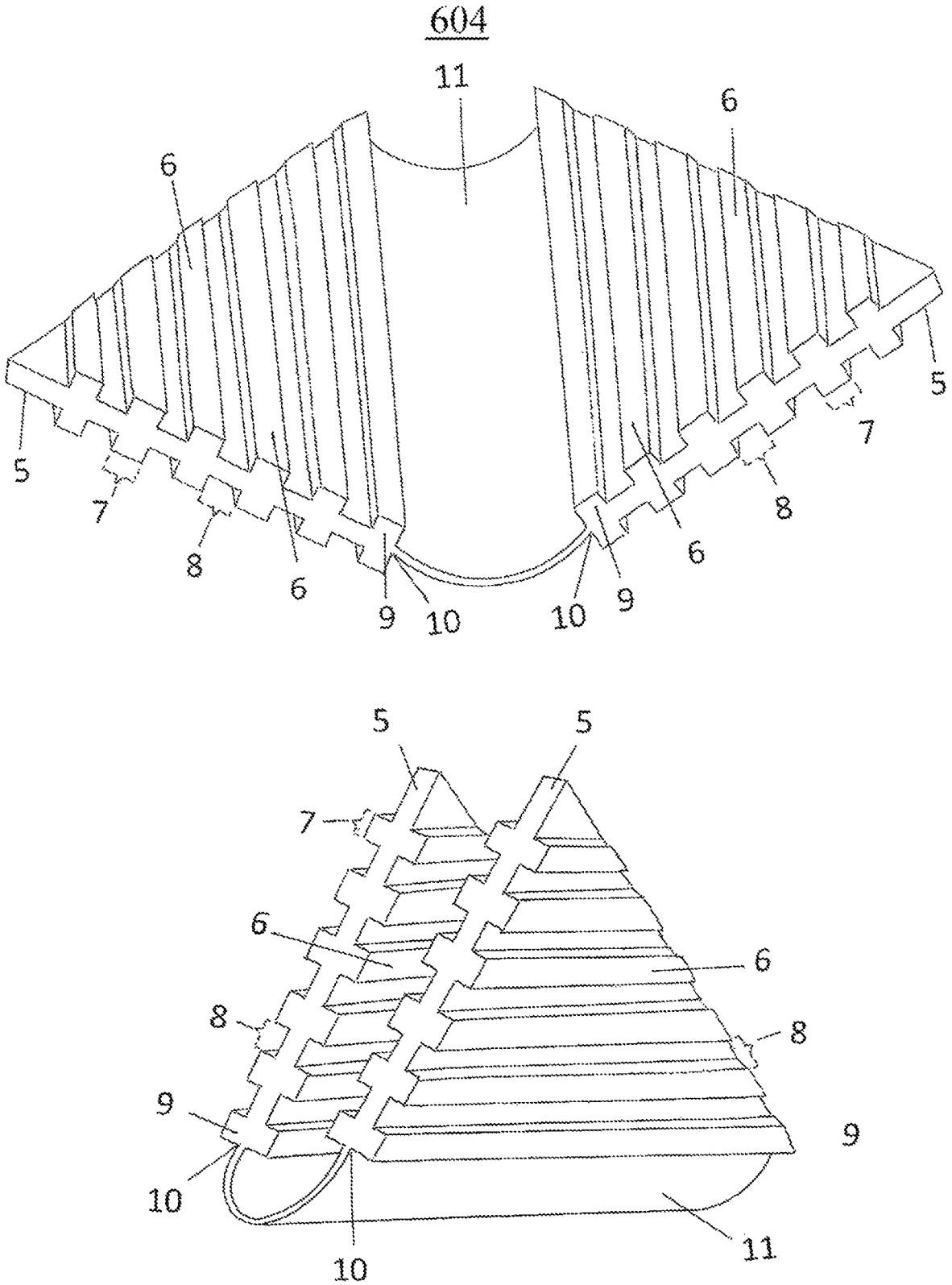
FIG. 8 shows a butterfly-shaped building piece with triangular wings in accordance with an exemplary embodiment of the present invention.

Referring now in detail to FIG. 8, butterfly-shaped building piece 604 is an example of building piece 60 as described above. The two plastic plates 5 (example of wings 61 and 62) take the shape of double triangle with rows of horizontal strip of interlocking prominences 6. Prominences 6 can be as small as half an inch or as big as two to three inches. Plate 5 can be as thin as one eighth inch or as thick as one quarter inch. Prominences 6 may be parallel horizontal strip of interlocking prominence. The horizontal strips of interlocking prominence 6 may be designed as square shape. Width 7 of horizontal strip 6, and the space or gap 8 between two adjacent horizontal strips 6, are equal. Therefore, parallel horizontal strip 6 can be snugly inserted into space 8 to interlock each other. The most inner horizontal strip 6 is strip 9, which has a middle portion 10. Flexible belt 11 (an example of belt 63) is about 1/16 inch in thickness and half an inch to three quarter inch in width. Flexible belt 11 connects two plates 5 together at their middle portions 10 to make building piece 604. Besides the middle portion 10, the flexible belt 11 may also be fixed to either the upper edge or the lower edge of the most inner horizontal strip 9.

Figure 9:
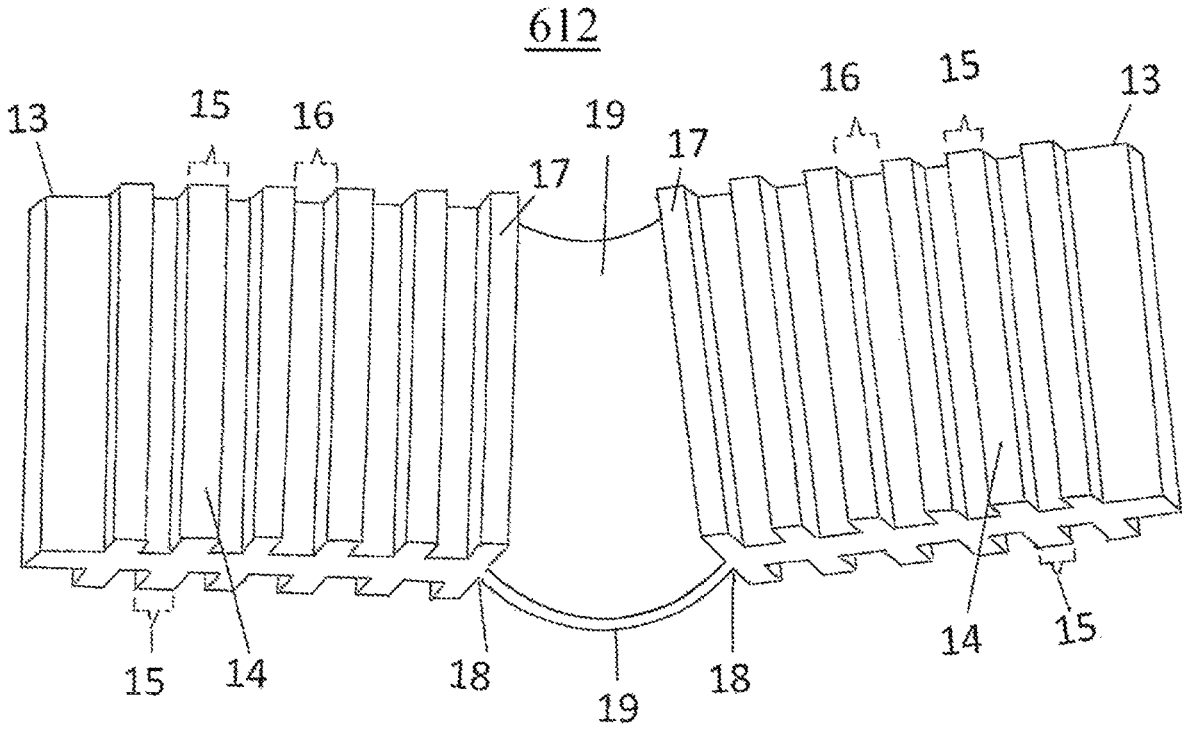
FIG. 9 shows a butterfly-shaped building piece including rectangular wings with horizontal strips in accordance with an exemplary embodiment of the present invention.
Figure 9:
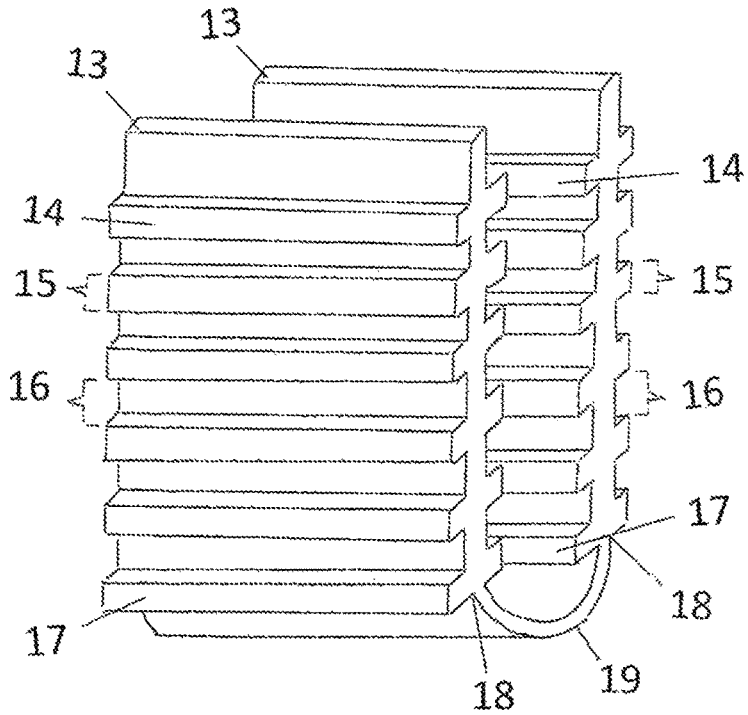

Referring now in detail to FIG. 9, butterfly-shaped building piece 612 is another example of building piece 60 as described above. The two plastic plates 13 (example of wings 61 and 62) take the shape of double rectangular with horizontal strips of long square interlocking prominences 14 with width 15. The space 16 between two adjacent strips 14 has a width that is equal to width 15. Therefore, strips 14 can be inserted snugly into spaces 16 to interlock each other. Among strips 14, strip 17 is the most inner strip having a middle portion 18. Flexible belt 19 may be about 1/16 inch in thickness and about half an inch to three quarter inch in width. Flexible belt 19 connects two elongated plates 13 together at their middle portions 18 to form piece 612.

Figure 10:
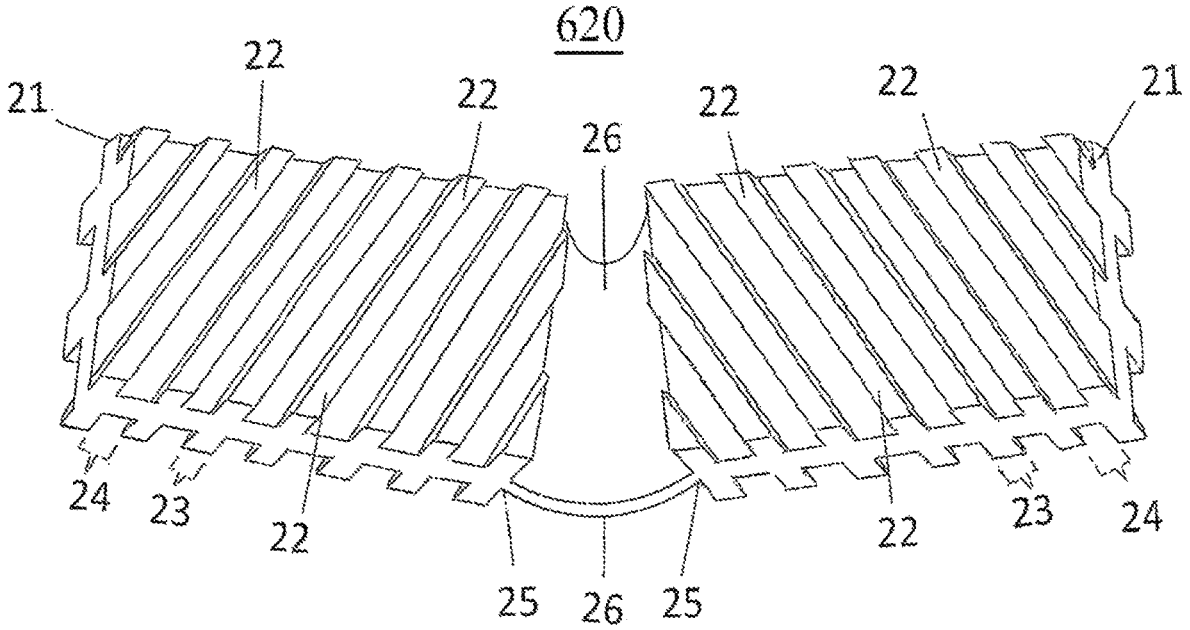
FIG. 10 shows a butterfly-shaped building piece including rectangular wings with oblique strips in accordance with an exemplary embodiment of the present invention.
Figure 10:
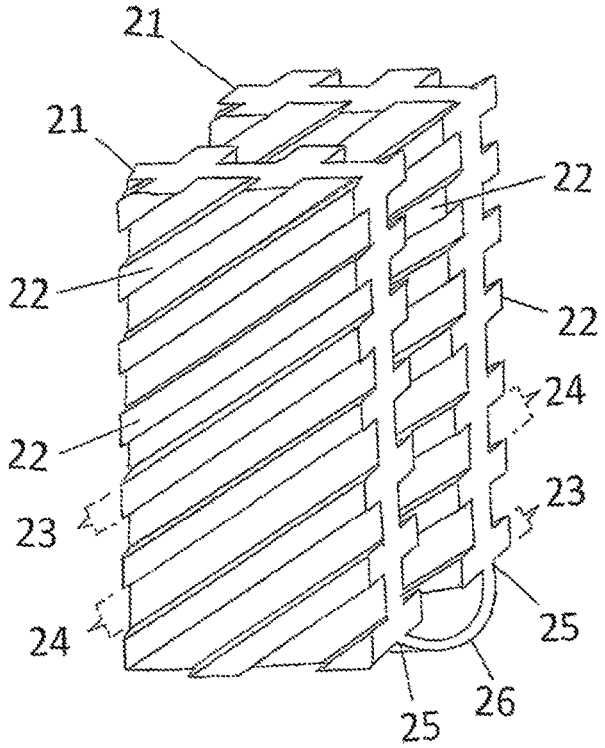

Building piece 620 in FIG. 10 is similar to piece 612 in FIG. 9, except the strip extension direction is different. Referring now in detail to FIG. 10, butterfly-shaped building piece 620 is another example of building piece 60 as described above. The two plastic plates 21 (example of wings 61 and 62) take the shape of double rectangular with multiple oblique strips of long square interlocking prominences 22 with width 23. Oblique strip 22 can be of variable degree from 15 degrees to 85 degrees to allow two pieces 620 to be connected at variety of angle. The space 24 between two adjacent strips 22 has a width that is equal to width 23. Therefore, strips 22 can be inserted snugly into spaces 24 to interlock each other. Among strips 22, the most inner (toward belt 26) strip has a middle portion 25. Flexible belt 26 may be about 1/16 inch in thickness and about half an inch to three quarter inch in width. Flexible belt 26 connects two elongated plates 21 together at their middle portions 25 to form piece 620.

It is contemplated that the flexible belt 63, 11, 19 or 26 can take the shape of any convex quadrilaterals, in which all interior angles are less than 180° and the two diagonals both lie inside the quadrilateral. For example, the belt's shape can be a trapezium, a trapezoid, an isosceles trapezoid, a parallelogram, a kite, a rhombus, a rectangle, an oblong, and a square. In preferred embodiments, the belt has four peripheral edges. Two wings 61/62 may extend from two opposite edges or "laterals" of the quadrilateral, the distance between which may be 100%, 80%, 60%, 40%, or 20% less than the distance between the other two opposite edges or "laterals". The distance between the other two opposite edges or "laterals" may be the same as the dimension of wing 61/62 along the edge or "lateral" of the quadrilateral that it extends from.

A user can connect together many pieces 60, 604, 612, 620 as well any other compatible pieces to create a variety of interesting things according to his or her imagination and talent.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A building piece comprising a first wing, a second wing, and a flexible belt connecting said two wings;

wherein the first wing has a first front side and a first back side, wherein the second wing has a second front side and a second back side, wherein at least two of the four sides each comprises a landscape (or a topographical profile), and the landscape on any one of said at least two sides can be reversibly interlocked to the landscape on another one of said at least two sides, wherein all the four sides each comprises a landscape, and any two of the four landscapes are structurally mutually complementary to each other, and are capable of interlocking to each other, and wherein the landscape on any one of said four sides can be reversibly interlocked to the landscape on a counterpart side in another identical building piece, i.e. it can interlock to itself.

2. The building piece according to claim 1, wherein the flexible belt can be bent or twisted at a degree of from −180° to +180° by human hands, so as to enable the interlocking of the two landscapes.

3. The building piece according to claim 1, wherein the wings are rigid, and can only be bent or twisted at a degree of less than 5° by human hands.

4. The building piece according to claim 1, wherein the material of the flexible belt is different from the material of the wings.

5. The building piece according to claim 4, wherein the material of the wings has an elastic modulus that is at least 2 times higher than that of the material of the flexible belt, wherein the term "elastic modulus" is a quantity that measures an object or substance's resistance to being deformed elastically when a stress is applied to it.

6. The building piece according to claim 1, wherein the wings have a thickness that is at least 2 times thicker than the thickness of the flexible belt.

7. The building piece according to claim 1, wherein the wings comprise a Lego piece.

8. The building piece according to claim 1, wherein the belt has a shape selected from a trapezium, a trapezoid, an isosceles trapezoid, a parallelogram, a kite, a rhombus, a rectangle, an oblong, and a square.

9. The building piece according to claim 1, wherein the landscape comprises multiple parallel interlocking prominences which enable one wing to interlock with another wing.

10. The building piece according to claim 1, which can connect to other building pieces to create a construction with a shape of human, animal, or plant such as lobster, butterfly, peacock and chicken.

11. The building piece according to claim 1, wherein the wings have a triangle shape, elongated shape, rectangular shape, square shape, diamond shape, star shape, leaf shape, animal shape, plant shape, round shape, gourd shape, or any combination thereof.

12. The building piece according to claim 1, wherein the landscape comprises long strips built on the wings at horizontal line or oblique line, with same degree of angle and spaced out at a distance equal to the strips' width.

* * * * *